US007842654B2

(12) United States Patent
Sherry et al.

(10) Patent No.: US 7,842,654 B2
(45) Date of Patent: Nov. 30, 2010

(54) METHOD, ARTICLES AND COMPOSITIONS FOR CLEANING BATHROOM SURFACES

(75) Inventors: Alan Edward Sherry, Cincinnati, OH (US); Jonathan Joseph Powell, Cincinnati, OH (US); Antonio Quintieri, Rome (IT); Francis Cornelio Ford, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 518 days.

(21) Appl. No.: 11/002,408

(22) Filed: Dec. 2, 2004

(65) Prior Publication Data

US 2005/0124519 A1 Jun. 9, 2005

Related U.S. Application Data

(60) Provisional application No. 60/526,501, filed on Dec. 3, 2003.

(51) Int. Cl.
*C11D 17/00* (2006.01)

(52) U.S. Cl. ..... 510/238; 510/438; 442/93; 15/104.93

(58) Field of Classification Search ..... None
See application file for complete search history.

(56) References Cited

U.S. PATENT DOCUMENTS

| | | | | |
|---|---|---|---|---|
| 3,981,826 | A | 9/1976 | Munro | |
| 4,759,865 | A | 7/1988 | Malihi | |
| 5,091,102 | A | 2/1992 | Sheridan | |
| 6,726,386 | B1 * | 4/2004 | Gruenbacher et al. | 401/7 |
| 6,814,088 | B2 * | 11/2004 | Barnabas et al. | 134/25.2 |
| 2003/0022572 | A1 | 1/2003 | Gott et al. | |
| 2003/0121530 | A1 | 7/2003 | Borgonjon et al. | |
| 2003/0165691 | A1 | 9/2003 | Smith et al. | |
| 2004/0068849 | A1 * | 4/2004 | Barge et al. | 28/104 |

FOREIGN PATENT DOCUMENTS

| | | | |
|---|---|---|---|
| WO | WO 01/38480 | * | 5/2001 |

OTHER PUBLICATIONS

International Search Report, May 17, 2005, 4 pages.

* cited by examiner

*Primary Examiner*—Necholus Ogden, Jr.
(74) *Attorney, Agent, or Firm*—Julia A. Glazer; Amy I. Ahn-Roll; Leonard W. Lewis

(57) ABSTRACT

The present invention relates to a disposable cleaning article for cleaning a bathroom surfaces which includes a layer of nonwoven substrate and a cleaning composition which can be either in a liquid or paste form. The cleaning article is water activate.

The present invention also relates to a method of cleaning a hard surface by adding water to a disposable cleaning article impregnated with a cleaning composition and then wiping the bathroom surface.

6 Claims, No Drawings

METHOD, ARTICLES AND COMPOSITIONS FOR CLEANING BATHROOM SURFACES

CROSS REFERENCE TO RELATED APPLICATION

This application claims the benefit of U.S. Provisional Application No. 60/526,501, filed on Dec. 3, 2003.

FIELD OF THE INVENTION

The present invention relates to a method, articles and compositions for bathroom cleaning. In particular, it relates to the use of disposable cleaning wipes containing a cleaning composition in pre-moistened or paste form that are water-activated for improved cleaning of soap scum, lime scale and mixtures thereof, and optionally mold and mildew soils found on bathroom surfaces.

BACKGROUND OF THE INVENTION

Disposable cleaning wipes and pads are well known in the art. These have been made for such diverse needs as car care, skin care and kitchen cleaning. Disposable cleaning wipes have two advantages. First, because the wipes include both substrate and cleaning chemistry in a single execution, the two components can be designed to maximize cleaning effectiveness; this is in contrast to conventional cleaning products for which the cleaning substrate and cleaner are independently selected and rarely coordinated. Second, disposable wipes are easy to use and throw away. Net, consumers achieve strong cleaning rewards and do so with less hassle.

Known disposable cleaning wipes for cleaning hard-surfaces are typically pre-moistened, and designed for single use on kitchen and bathroom surfaces; Known single-use disposable cleaning wipes are not adapted for the removal of soap scum and lime scale, which is a typical need in cleaning bathroom surfaces such as bathtub and shower enclosures. The disposable cleaning wipes known in the art do not comprise enough cleaning actives, nor sufficient solvent and/or water, to clean an entire bathtub or shower enclosure. Tough soils such as soap scum, lime scale and mixtures thereof are not sufficiently softened by the wipe chemistry and remain difficult to remove, even with use of multiple wipes.

It has now been found that effective and convenient cleaning of such bathroom surfaces can be accomplished by single-use disposable wipes, in which the cleaning composition present on the wipe is activated by water and released on the bathroom surface to be cleaned.

Furthermore, specific cleaning compositions in the form of aqueous solutions or pastes, have been formulated, which are very effective at removing soap scum, lime scale and mixtures thereof, from bathroom surfaces, when used in combination with single use disposable wipes of the invention and according to the water-activation method herein disclosed.

Additionally, specific compositions in paste form have been created which provide excellent cleaning, ease of finished product manufacturing, and product aesthetics advantages.

Methods for the cleaning of hard surfaces that involve addition of water to disposable cleaning wipes in paste or pre-moistened form are known in certain areas, particularly in the dishwashing area. U.S. Patent Application publication No. 2002/0132747 to Huyhn et al., published Sep. 19, 2002, and assigned to The Procter & Gamble Company, discloses a process for cleaning dishware using a two-sided kitchen wipe, which can be dry or wet to the touch. U.S. Patent Application publication No. 2003/0100462 to Suazon et al., published May 29, 2003 and assigned to The Colgate-Palmolive Company discloses a dishwashing cleaning wipe that is substantially dry to the touch comprising (a) 20% to 95% of a water insoluble substrate and (b) 5% to 80% of a cleaning composition impregnated in said water insoluble substrate, said composition comprising: 20-60% of a sulfonated surfactant, 30-65% of an ethoxylated nonionic surfactant, 1-10% of polyethylene glycol wherein the composition contains less than 10% water. U.S. Patent Application 2003/0100462 additionally discloses a method of cleaning by wetting a dish wipe with water.

The above cleaning composition wipes are not suitable for cleaning bathroom soils such as soap scum and lime scale and mixtures thereof.

Multi-use wipes for specific use in the bathroom are also known in the art. U.S. Pat. No. 4,759,865 discloses a pasty detergent composition for cleaning bathroom compositions that comprises a pasty mass made by dry mixing alkyl benzene sulfonic acid followed by neutralization with a caustic solution, active organic acid and filler. The gluey detergent paste serves both as an active cleaning component and a carrier for organic acids for the removal of lime scale and soap scum, and is used as such, without water-activation.

Representative of known single use wipes for hard-surfaces is U.S. Pat. No. 6,376,443, which discloses a bathroom wipe comprising a water insoluble substrate and an aqueous cleaning composition at a load factor up to 2.25 g/g, said cleaning compositions consisting of 0.1% to 5% zwitterionic surfactant, 0.5% to 10% C1-C4 alkanol, 0.5% to 8% of a cosurfactant, 0.1% to 1% of an antirain or antidust agent and 0.05% to 3.0% of a proton donating agent at a pH from about 3 to about 7.

It is therefore an object of this invention to provide a method for cleaning bathroom surfaces, in particular soap scum and lime scale and mixtures thereof in bathroom tub and shower enclosures, with a cleaning wipe that delivers sufficient mileage for the cleaning of a full bathtub or shower enclosure with a single cleaning wipe, and without the need for more than one product for the entire cleaning process. Since the size and number of surfaces can vary from consumer to consumer or even for the same consumer on different occasions, the invention also provides for limited re-use. Limited re-use provides the ability, if the consumer chooses, to use single wipe to do small job, store and re-use it again for an additional job or until the chemistry is exhausted.

It is another object of this invention to provide superior performing articles for cleaning bathroom surfaces, containing cleaning wipes comprising at least one nonwoven substrate impregnated with a cleaning composition in aqueous or paste form.

It is a further object of this invention to provide superior cleaning compositions, particularly in paste form, preferably to be used with the method and articles of the invention.

SUMMARY OF THE INVENTION

In a first main embodiment, the present invention relates to:

A method for cleaning bathroom surfaces, particularly tub and shower enclosures with a single use disposable cleaning wipe, comprising the steps of:

- providing a disposable wipe containing a cleaning composition in paste or aqueous form;
- contacting said wipe with water to activate the wipe;
- contacting the activated wipe with the bathroom surface to be cleaned;
- optionally but preferably rinsing the surface with water.

The method herein is particularly targeted at cleaning soap scum, lime scale and mixtures thereof In a preferred embodiment, the method can additionally provide antibacterial, antiviral and antifungal benefits.

In a second main embodiment, the present invention relates to an article for cleaning bathroom surfaces, comprising a disposable cleaning wipe comprising at least one nonwoven substrate having a basis weight of from about 20 g/m$^2$ to about 200 g/m$^2$, and a cleaning composition comprising at least about 5% surfactants and at least about 3% of one or more organic or inorganic acids and mixtures thereof, wherein said weight of cleaning composition per area in said nonwoven substrate is from about 0.005 g/cm$^2$ to about 0.60 g/cm$^2$, more preferably from about 0.015 g/cm$^2$ to about 0.30 g/cm$^2$, and most preferably from about 0.025 g/cm$^2$ to about 0.20 g/cm$^2$.

The articles herein can consist of said cleaning wipes, or can additionally comprise an implement to which the wipe is releasably attached during the cleaning operation, said implement comprising a head to which the wipe is attached and optionally a handle and/or a pole.

The wipes for use in the method and articles herein are preferably a laminate of at least 2 nonwoven substrates forming two sides, at least one of them being a side useful for cleaning, and the composition is preferably applied on the cleaning side, preferably in a distinct pattern.

The cleaning composition for use in the method and article herein is preferably selected from the group of:

Pastes and aqueous compositions containing at least about 5% surfactant and at least about 3% of one or more organic or inorganic acids and mixtures thereof, wherein the pH of a 10% solution of said pastes and aqueous compositions is from about 0.5 to about 6;

Pastes and aqueous compositions containing at least about 5% surfactant and at least about 3% of one or more sequestrants, wherein the pH of a 10% solution of said pastes and aqueous compositions is from about 6 to about 12;

wherein said composition preferably comprises at least about 3% of one or more hydrotropes and/or at least about 1% of one or more organic cleaning solvents.

In a third main embodiment herein, the present invention relates to a cleaning composition for bathroom surfaces, in particular for soap scum, lime scale, and preferably mold and mildew, in the form of a paste, said paste comprising:

At least about 5% surfactants, at least about 3% of one or more organic or inorganic acids and mixtures thereof, and additionally comprising at least about 3% of one or more hydrotropes and/or at least 1% of an organic solvent, wherein the pH of a 10% solution of said composition is from about 0.5 to about 6; or At least about 5% surfactants, at least about 3% of one or more sequestrants, and additionally comprising at least about 3% of one or more hydrotropes and/or at least 1% of an organic solvent wherein the pH of a 10% solution of said composition is from about 6 to about 12.

Surfactants are preferably present at levels of from about 7.5% to 80% more preferably from about 10% to about 70%, most preferably from about 15% to about 50%, and at least one surfactant is preferably selected from the group consisting of anionic sulfonate surfactants.

Hydrotropes are selected from the group consisting of toluene, xylene and cumene sulfonate salts, C6-C12 diphenyl ether disulfonate salts, C4-C6 alcohol ethoxylates, C4-C6 glycosides, 2-ethyl-1-hexyl sulfate salts, mono- and di-2-ethyl-1-hexyl sulfosuccinate salts, and C8-C22 alkyl ethoxylates having an HLB greater than about 12, and mixtures thereof.

In the acidic compositions herein, the acids are preferably present at levels of from about 10% to about 40% and are preferably selected from the group consisting of adipic acid, citric acid glutaric acid, glycolic acid, maleic acid, phosphoric acid, succinic acid, sulfamic acid and mixtures thereof.

In the neutral or alkaline composition herein, the sequestrants are preferably present at levels of from about 10% to about 50% and are preferably selected from the group consisting of the sodium, potassium, ammonium and alkanolammonium salts or partial salts of nitrilo triacetic acid, methyl glycine diacetic acid and ethylene diamine tetraacetic acid.

The organic solvents are present at levels of at least about 5%, and are preferably glycol ether solvents selected from the group consisting of dipropylene glycol n-butyl ether, dipropylene glycol n-propyl ether, tripropylene glycol n-butyl ether, tripropylene glycol n-propyl ether, ethylene glycol n-hexyl ether, diethylene glycol n-hexyl ether, and mixtures thereof.

The cleaning compositions also preferably contain at least one surfactant selected from the group of betaines, zwitterionic and amphoteric surfactants and mixtures thereof.

The cleaning compositions preferably contain from about 3% to 20% of one or more bleaches or bleaches precursors selected from the group consisting of hydrogen peroxide, sodium percarbonate, sodium perborate, and the sodium and potassium salts of persulfate, hypochlorite, hypobromite and mixtures thereof.

DEFINITIONS

All documents cited herein are, in relevant part, incorporated herein by reference; the citation of any document is not to be construed as an admission that it is prior art with respect to the present invention.

It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

All pH measurements on pastes and aqueous cleaning compositions are performed by removing said cleaning compositions from the wipe, and making a 10% solution of the cleaning composition prior to conducting a pH measurement. This is needed, especially for paste compositions since pH is not easily or accurately measures on a concentrated chemical composition.

As used herein, a 'paste' is a chemical composition comprising from 0% to about 40% water, with a minimum viscosity of 50 Pascal seconds (Pa·s) at a shear rate of 1 s$^{-1}$. It is noted that the solvent content can exceed about 40%, but if so, at most 40% of the composition can be water. The water can be of any source; water specifications are more fully described in the section below describing 'aqueous composition'. In one extreme, the paste is a powder or solid that contains only trace amounts of water, more preferably at least about 1% water, still more preferably at least about 2% water, and most preferably at least about 3% water. In another extreme, pastes can comprise water content as high as about 40%, more preferably from about 5% to about 30%, more preferably from about 6% to about 25%, still more preferably from about 7% to about 20% and most preferably from about 7% to about 15% water. The exact water content will depend on the level of other solvents in the paste and the desired Theological properties of the paste. The viscosity of the paste is generally inversely proportional to liquid content (at 25° C.) in the composition, including water and other solvents. Preferably, the viscosity of the paste is at least about 75 Pa·s, more preferably at least about 100 Pa·s, most preferably at least about 150 Pa·s at a shear rate of 1.0 $s^{-1}$. Preferably, the viscosity of the paste is at most about 10,000 Pa·s, more preferably at most about 5000 Pa·s and most preferably at most about 1,000 Pa·s at a shear rate of 1.0 $s^{-1}$. The preferred viscosity ranges will depend on the specific paste composition components. Any range consisting of a minimum viscosity level and a maximum viscosity level defined above can be used.

As used herein an 'aqueous composition' is a composition that comprises at least about 20% water, more preferably at least 30% water, more preferably still at least 40% water, most preferably at least 50% water. The water source can be any of those known in the art. Water hardness can range anywhere from 0 gpg to 50 gpg. Preferably, the water in the premoistened wipe is highly purified or is at least soft water, with hardness ranging from 0 gpg to 3 gpg. Water purification, if used, can be achieved by any means known in the art, including distillation, de-ionization and demineralization. The aqueous cleaning composition can be in the form of, for example, an isotropic liquid, a hazy liquid (nearly isotropic), an emulsion, microemulsion, or alternatively in the form of a gel or thickened solution that is transparent, translucent and can optionally be opacified. Aqueous compositions can also have any viscosity.

By 'bathroom tub and shower enclosures' or 'enclosure areas', it is meant all of the inanimate surfaces that are typically associated with a modern household bath or shower facility. Bath and shower enclosures typically have dimensions of no more than about 3 meters in length by no more about 3 meters in width and include a combination of one or more of the following: bathtubs, shower heads, fixed or sliding entry doors, rails, curtains, walls, tile, grout, and assorted fixtures for dispensing hot and cold water to the bathtub or shower area.

By 'soap scum', it is meant soil that results from the reaction of body soils with water hardness. Soap scum is highly water-insoluble and comprises, among its major components, calcium salts of fatty acids. Soap scum is rarely encountered alone in bathtub enclosures; it typically is found in combination with lime scale soil By 'lime scale', it is meant the soil that results from evaporation of water with a hardness above 0 grains per gallon (gpg). By hardness, it is meant the combination of mineral salts known to be present in most water used in bathtub or shower enclosures; the mineral salts include significant levels of magnesium and calcium salts and lower levels of transition metal salts. Bathtub and shower enclosures, especially those comprising glass doors, are easily soiled by water droplets containing hardness, which tenaciously adhere to glass and enamel surfaces, and dry out leaving tough-to-remove water spots.

By 'single use disposable wipe', it is meant a cleaning wipe designed for the complete cleaning of one heavily soiled bathtub or shower enclosure; the wipe is preferably disposed once the cleaning task is complete. 'Single use' means that the cleaning chemistry in or on the wipe is sufficient but not excessive for the cleaning of one heavily soiled, large bathtub or shower enclosure. It is possible to use 'single use' disposable wipes to clean two bathtub or shower enclosures, maybe even three, if the bathroom or shower enclosures are smaller or are not heavily soiled. Some users may even choose to save and store the cleaning wipe product after a single use, preferably a light duty single use, for a subsequent bathroom cleaning operation at a later time. 'Single use' also takes into account some users who choose to save and store the cleaning wipe product after a smaller job for a subsequent bathroom cleaning operation at a later time in order to get better value from the wipe. This is defined as 'limited re-use'. However, the 'single use disposable wipe' product form discourages multiple uses beyond those described above, either because of limitations on chemistry amount or dilution of actives, or because of physical limitations on the substrate. 'Wipes' comprise at least one nonwoven and cleaning chemistry either on the surface of the wipe (usually pastes) or impregnated in the wipe (aqueous compositions). For 'disposable wipes', either the integrity, or effectiveness, or aesthetic appeal, of the wipe rapidly diminishes with repeated use, signaling the need for it to be disposed. This built-in physical or aesthetic deterioration in performance will discourage further use of the wipe or application of additional paste or aqueous chemistry to the substrate following its initial use, limiting the wipe's lifetime.

As used herein, the term 'cleaning wipe' refers to a 'single use disposable wipe' for the cleaning of soils including soap scum, hard water and mixtures thereof in bathtub or shower enclosures.

By 'cleaning implement' it is meant a durable, reusable, multiuse cleaning tool that assists the cleaning of hard surfaces. The implement is not a cleaner and does not comprise a cleaner; instead the implement attaches to, via the implement head, a single use disposable wipe that comprises ready to be water-activated cleaning chemistry. The implement head is in direct contact with the single use disposable wipe during the cleaning process. A cleaning implement can also optionally include a handle and/or pole attached to the implement head to help the user direct the cleaning task at a further distance from the hard surface to be cleaned.

DETAILED DESCRIPTION OF THE INVENTION

Method

In a first main embodiment herein, the present invention relates to a method for cleaning bathroom surfaces, particularly tub and shower surfaces, comprising the steps of Providing a disposable wipe containing a cleaning composition in paste or aqueous form;

Contacting said wipe with water to-activate-the wipe;

Contacting the wipe with the bathroom surface to be cleaned; and

Optionally but preferably rinsing the surface with water.

In one embodiment, the previous method of cleaning a bathroom surface is performed by further attaching the disposable wipe to a cleaning implement. The wipe is preferably attached to the implement prior to contacting the wipe with water.

The present method is particularly adapted for cleaning soap scum, lime scale, and mixtures thereof. In a preferred embodiment, the method can additionally target antibacterial and antifungal benefits. However, one skilled in the art will appreciate that despite the particular efficacy of the previously discussed method and cleaning wipes (described herein after) for cleaning bathroom surfaces, the same method and wipes can also be used to clean any other kind of surfaces, in particular hard surfaces.

It will be understood that any of the disposable wipes and cleaning compositions described hereinafter can be used in the method of cleaning a bathroom surface previously described.

Water Activation:

The wipes herein must be water-activated according to the present method. Water activation can involve addition of water to the aqueous or paste-containing cleaning wipes, or addition of water to the hard surfaces to be cleaned, followed by contacting the cleaning wipe with the water on said hard surfaces. Alternatively, water activation can be achieved by a dosing device, preferably a dosing device that is removably attached to the cleaning implement head, handle and/or pole as described in the 'rinsing' section of the disclosure. The essential feature is that the cleaning wipe be contacted with water. Water activation can be used once or more during the cleaning process; preferably, water activation is used several times. Most preferably, the wipe is first water-activated then used for cleaning, then reactivated as needed to complete the cleaning task or until the contents of the premoistened wipe or paste wipe are spent. Warm or hot water is advantageously used in the water activation process; the water has a temperature preferably from about 30° C. to about 45° C., more preferably from about 35° C. to about 40° C., most preferably near 37° C., for speedy dissolution of the aqueous or paste-containing composition and high cleaning effectiveness of the water-activated chemical composition and maximum skin safety for the user. The water is preferably substantially free of bacteria and of soft hardness, preferably less than about 10 grains per gallon (gpg). The amount of water used to activate the product will vary from user to user and in part depend on the amount of preloaded chemistry and on the size and mass of the cleaning wipe. However, it is preferable that the cleaning side which can include a nonwoven material, of the cleaning wipe be saturated with enough water to clearly see the formation of suds at the wipe-air interface prior to use.

Any means for contacting the cleaning wipe with water can be used. Typically, water activation is achieved by exposing the cleaning wipe directly to a water source readily available in the bathtub or shower enclosure area, such as a bathtub faucet or shower head. Water can also be sourced from other locations and transferred to the wipe or surface to be cleaned by means of, for example, syringes, garden hoses, spray bottles, beverage containers, buckets, and the like. In one preferred embodiment of the method of the present invention, a bathtub or shower floor area is partially filled with warm to hot water (preferably 30° C.-45° C.) from the bath or shower faucet, and the cleaning wipe is dipped into the pool of water as needed for water activation. During the water activation process, the wipe can be directly handled by the user, or can be releasably attached to an implement, said implement comprising a head or optional handle and or/pole. Water activation via the implement allows the user to stay in control of the cleaning process without getting wet or exposed to warm/hot water, or to chemicals on the cleaning wipe.

Cleaning:

Once the cleaning wipe is water-activated, it is ready to be used for cleaning. Cleaning consists of contacting the water activated wipe with the bathroom surface to be cleaned, in particular soiled bathtub or shower enclosure. This can be achieved in any manner as desired by the product user. Hand use can be preferable, particularly for easy-to-reach but tight areas, and for the cleaning of fixtures, such as bathtub and shower faucets, that occupy small areas in the bathtub or shower enclosures and are highly contoured.

For cleaning bathtub and shower enclosures, it is advantageous to treat the most heavily soiled areas first, and then tackle less soiled surfaces prior to rinsing the treated bathtub/shower enclosure. This cleaning method prolongs the cleaning composition dwell time on the toughest soils, leading to enhanced softening and removal of these soils. The toughest-to-clean surfaces will vary from household to household and from bathroom to bathroom, and will depend on the actual bathtub/shower enclosure area set-up, quality of the components in the bathtub/shower facility, age of those components, and wear and tear. For instance, sliding or fixed glass doors that are sometimes part of the bathtub/shower enclosure can be soiled with tough-to-remove scale marks. As such, the cleaning of soiled glass doors is preferably performed early in the cleaning process. In general, the water activated cleaning wipe is first applied to the soiled lower part of the bathtub, 'ring' around the bathtub, or lower portion of the shower enclosure to remove tenacious hard water scale and soap scum in these areas.

Optional Rinsing Step:

Rinsing can be accomplished by any means known in the art. Showerheads can be angled and water turned on for rinsing. Showers are also equipped, or can be equipped with hoses and/or detachable showerheads that make it easy to reach and rinse all corners of a bathtub or shower enclosure. Rinsing can also be achieved by splashing water onto the cleaned surface either by hand or using a dosing mechanism such as a cup, glass, pan, squirt bottle, or any other device capable of holding and dispensing water. Alternatively, rinsing can be accomplished by mechanical means, including pressure activated garden hoses, trigger-activated devices (e.g., Super Soaker) and the like or electronic means such as battery-operated sprayers. Alternatively, the implement can optionally include a rinsing dispensing device that is preferably removable, as described herein after.

The cleaning wipe itself can act as a rinsing aid, especially if the chemical contents on the wipe have been exhausted. In one embodiment, the cleaning wipe comprises one outer surface comprising synthetic fibers on which, or close to which, a cleaning paste is loaded, and a second exposed outer surface composed primarily of cellulose-based fibers, which can be used for rinsing. At the time of rinsing, the wipe is turned inside out and the cellulose side is used for rinsing either alone, or in combination with a water rinsing dispensing system, a squeegee or combinations thereof Rinsing temperature is not critical to the process and can be varied according to the preference of the user.

In another embodiment, the excess cleaning actives remaining on the bathtub or shower enclosure following treatment with the water-activated wipe can be removed via a squeegee either with or without use of rinsing water, wipe or rinsing dispensing device. The squeegee can be used as a separate tool or can be attached, either permanently or more preferably in removable fashion, to the implement. For example, the squeegee can be secured to the implement head, handle and/or pole by means of a plastic clip.

Following the cleaning of the lower bathtub, bathtub soil ring and/or lower shower areas, the wipe is preferably used to clean other typically less soiled areas in the bath-shower enclosure area, including upper flat portions of the bathtub, tile above the bathtub if present, grout lines if present, walls and fixtures. Throughout the cleaning process, the cleaning wipe is preferentially re-activated as needed to release actives until either the wipe is essentially depleted of actives or the cleaning task is completed. So as to better visualize treated and untreated areas, the cleaning chemistry is preferably designed to generate significant levels of suds. This allows users to better estimate product mileage. To assist visualization of product usage and product consumption a dye or ink is also preferably incorporated as part of the cleaning wipe chemistry. Loss of the color from the cleaning wipe signals that the cleaning composition is used up. The ability to signal end point can be further enhanced by using a dye that is pH sensitive. Particularly for significantly acidic and alkaline compositions, the dye can be chosen to change color or to lose color entirely as the pH of the wipes changes from chemistry being depleted.

Article

In one embodiment, the article for cleaning of bathroom surfaces can be particularly adapted and efficient in cleaning of soap scum and lime scale stains on bathtubs and shower enclosures. The article includes a disposable cleaning wipe comprising at least one nonwoven substrate having a basis weight of from about 20 g/m$^2$ to about 200 g/m$^2$, and a density of at least 0.15 g/cm$^3$ and a cleaning composition comprising at least about 5% surfactant and either at least about 3% of one or more organic or inorganic acids or at least about 3% of one or more sequestrants.

It is a particular feature of the articles herein that the cleaning composition be applied onto said nonwoven substrate, in a certain ratio of composition weight per substrate area. The weight of cleaning composition per area in said nonwoven substrate is from about 0.005 g/cm$^2$ to about 0.60 g/cm$^2$, more preferably from about 0.015 g/cm$^2$ to about 0.30 g/cm$^2$, and most preferably from about 0.025 g/cm$^2$ to about 0.20 g/cm$^2$.

In one embodiment, the nonwoven substrate can be a laminate of at least 2 nonwoven layers forming two sides, at least one of them being useful for cleaning; the compositions can be loaded onto any one or any number of substrate layers comprising the cleaning wipe as long as the cleaning composition is capable of migrating towards the cleaning side and then be applied on the surface to be cleaned during the cleaning operation. Preferably the cleaning composition is applied directly onto the cleaning side of said laminate. Compositions in the form of a liquid will typically seep into and through the various layers of the cleaning wipe.

In a preferred embodiment of the article herein, the cleaning composition is in the form of a paste and the paste is incorporated on or into the cleaning wipe. A non-limiting example of how paste compositions can be incorporated onto nonwoven substrates is discussed in U.S. Patent Application publication No. 2003/0121530 to Borgonjon et al., published Jul. 3, 2003, and assigned to The Procter & Gamble Company. In one embodiment, the paste is loaded onto the face of a nonwoven substrate layer, which may or may not be laminated to other nonwoven substrates, the paste is colored (i.e., a color different than that of the substrate), is easily visible on the cleaning wipe, and can be directly touched by the user without removing any nonwoven layers that may lie to the outside of the nonwoven layer comprising paste. The paste is preferably loaded directly onto one of the sides of the nonwoven substrate layer of the cleaning wipe, thereby advantageously placing the cleaning actives in proximate contact with the surface to be cleaned. Alternatively, the paste can be loaded onto outer-facing side of a nonwoven substrate and then, it can be covered with a low density nonwoven layers lying on top of the paste, enabling the user to easily visualize and touch the paste through the non-paste-containing outer layers. By 'low density', it is meant that the outer layer has a density of from about 0.0005 g/cm$^3$ to about 0.1 g/cm$^3$, more preferably from about 0.001 g/cm$^3$ to about 0.09 g/cm$^3$. Such outer layers are preferably lofty nonwoven structures to assist in the generation of suds. The article herein preferably includes an external scrim layer designed to aid scrubbing of surfaces to be cleaned. For example, a low density polyester layer sandwiched between the paste and an outer scrim layer will allow the flow of paste and/or water-solubilized paste to the hard surface, and additionally assist in the generation of foam or lather as a result of friction created by the surfactant solution traversing through the highly aerated low density polyester substrate and scrim. As such, it is highly beneficial to build advantageous rheological properties into the paste so as to maximize the flow of paste to the surface to be cleaned and encourage speedy dissolution of the paste to form concentrated solutions for cleaning.

In one embodiment, the article herein consists of said cleaning wipe, and the method herein relies on hand-use of the cleaning wipes. To facilitate and encourage hand use, the substrate is preferably coated with cleaning paste on one of the outer nonwoven layers of the cleaning wipe such that the paste is easily visible and can be touched directly by the user without removing any nonwoven substrate layers.

In one embodiment, a sleeve can be formed by bonding a layer of nonwoven material to a side of the cleaning wipe. In a preferred embodiment, this nonwoven layer is connected to a non-cleaning side of the wipe (i.e., a side not useful for cleaning such as for example a barrier layer or impervious layer) Once bonded, this sleeve provides a pocket that allows for easy fit and retrieval of a consumer's hand or fingers. Incorporation of a pocket into the design of the wipe enables consumers to create pressure points as needed on the wipe, thereby facilitating the cleaning process. The pocket also enables greater control of the wipe and provides protection against adverse effects of concentrated and potentially aggressive chemicals embedded on the substrate. In a preferred design, the pocket is advantageously made to function as both as an attachment mechanism to the implement head (vide infra) and as a means of housing the user's hand or fingers for improved convenience and cleaning effectiveness.

In another embodiment herein, the articles herein consist of an implement onto which cleaning wipes are attached, preferably in a releasable manner. In one embodiment, a cleaning implement comprises a handle for allowing a user to clean a bathroom surface with the disposable wipe while limiting contacts of the user's skin with the cleaning wipe and cleaning composition during the cleaning operation. In a preferred embodiment, the cleaning implement for use herein comprise a mop head to which the wipe is attached. One example of a suitable cleaning implement for use with the cleaning wipe of the present invention is disclosed in U.S. provisional patent application Ser. No 60/499,851 to Goh et al., filed Aug. 27, 2003, and assigned to The Procter & Gamble Company. A suitable cleaning implement can include a pole which is preferably rotatably connected to a mop head.

The pole can be any pole know in the art such as segmented pole, telescopic pole, collapsible pole and can be made of any suitable material.

The mop head can have any dimensions and any shape. Preferably, the mop head has an upper and a lower surface region which are relatively flat and optionally textured. The shape of the implement head, especially the lower surface area of the implement head, can be circular, oval shaped, iron shaped, triangular, square, rectangular, trapezoidal, pentagonal or hexagonal. In a preferred embodiment, the mop head is malleable and flexible such that it easily conforms to the rounded contours of non-flate surfaces such as bathtubs. The flexibility can be achieved by manipulation of the material that makes up the implement head; the implement head is preferably at least partially made from polyurethane or other foam, ethyl vinyl acetate or a form of rubber or any other material that ensures flexibility. The dimensions of the cleaning wipe attached to the implement can be smaller, the same size or larger than the dimension of the implement head. Preferably, the dimensions of the cleaning wipe are sufficient to fully cover the entire lower face of the implement head face, and more preferably are larger at some points to the extent that the wipe overhangs beyond the perimeter of the lower surface region of the implement head on at least part of one side or more. Wipe overhang beyond the perimeter of the lower face of the implement head enables the user to put pressure on at least a portion of one of the sides of the implement head, allowing the overhanging wipe portion to rest against the implement head side for improved leverage for scrubbing tough-to-clean dirt or for penetrating deep into surface edges, grooves, or grout lines. This is especially useful for the cleaning of mold and mildew stains. In a preferred embodiment, at least one of the sides of the mop head is made of a harder material than the rest of the sides so as to encourage its use, preferably in combination with overhanging substrate, for scrubbing or grout line penetration. The overhanging part of the cleaning wipe can also advantageously comprise one or more abrasive materials to facilitate scrubbing action and grout line cleaning. In a preferred embodiment, the wipe has on one side a textured abrasive surface formed from nodules and/or striations of abrasive material applied thereon, the abrasive material having preferably a hardness of from about 40 to about 100 Shore D units using a Bareiss HHP 2000 Shore Hardness tester. The abrasive material enables the wipe to produce a mild scouring or abrasive action to help mechanically dislodge soap scum, hard water, and combinations thereof from surfaces in bathtub and shower enclosures. The abrasive material can cover from about 5% to about 50% of the outer surface area of the wipe side in which it is located.

The attachment mechanism between cleaning wipe and implement head can be any known in the art. For example, external attachment mechanisms such as elastic bands, flexible straps or belts can be used to secure the cleaning substrate on the implement head. More preferably, at least part of the attachment mechanism is housed on or in the implement head. Non-limiting examples of such attachment mechanisms include adhesives, hook and/or loop fasteners such as VELCRO®, slitted structures such as those found on the SWIFFER® dusting mop implement heads, pins, bristles, clips and clamps. By adhesives, it is meant tacky polymers such as polyisobutylene and pressure sensitive adhesives such as those sold by HB Fuller with names HL-1496, HL-1500, HL-1597, HM-1902, HM-1972, HM-2713 and the like. The adhesives are preferably chosen to be water and chemically resistant and are located on the lower face of the implement head. When hooks are used, the hooks are also preferably water and chemically resistant, and are located preferably on the lower face of the implement head, i.e., facing the surface to be cleaned. The wipe then requires loops that are congruent to the implement hooks to complete the attachment mechanism.

Bristles are well known in the art, especially in the context of tooth brushes and scrubbing tools for hard surface cleaning. In the context of the present invention, bristles on the lower face of the implement head can be used to maintain the cleaning wipe on the implement head. Preferably, the bristles are chosen so as to penetrate into the cleaning wipe, without causing damage to the wipe's integrity. One advantage of bristles is a large number of attachment points between implement head and cleaning wipe; another advantage is that the bristles, in combination with the cleaning wipe can provide effective scrubbing, both real and perceptual, while limiting the possibility for surface damage. The individual bristle strands can be made of any material know in the art such as polyethylene, polypropylene, polyesters, polyamides (e.g., nylon variants), and blends thereof. In one embodiment, the length of the bristle strands is between about 0.5 cm and about 6 cm, preferably between about 0.5 cm and about 5 cm. The width or diameter of the bristle strands can be between about 0.01 mm and about 5 mm, preferably from about 0.02 mm and about 3 mm, most preferably from about 0.03 mm to about 2 mm. The strands are preferably grouped in bunches that are spaced apart from each other and are attached or bonded to the lower surface region of the implement via any means known in the art. In one embodiment, the spacing between the bunches is between about 0.25 cm and about 3 cm, preferably between about 0.5 cm and about 2 cm. Bristles can cover the entire area of the bottom of the implement head, or be positioned at specific points such as at the front end of the implement so as to encourage the use of bristles as specific pressure points on the implement head.

In one embodiment, the attachment mechanism between cleaning wipe and implement head can be fully located on the substrate. For example, a sleeve can be fastened on all sides but one of the cleaning substrate, preferably a side perpendicular to the longest axis of the implement head, so as to form a pocket of sufficient size to house at least a portion of the implement head, preferably along the width of said implement head, thereby securing part of the cleaning wipe into the implement head, preferably along the width of said implement head. The size of the pocket can be adjusted depending on the fit desired between the substrate and the implement. Preferably, the size of the pocket is sufficient to house from about one twentieth to about one half of the implement head surface area, more preferably from about one fifteenth to about one third of the implement surface area. In a preferred embodiment, the pocket is advantageously made to function as both an attachment mechanism to the implement head and as a means for housing the user's hand or fingers for improved convenience and cleaning effectiveness.

A combination of fastening mechanisms can also be used to attach the substrate to the implement head. For example, the implement head can comprise one or more grippers and one or more pins. In a preferred embodiment, the attachment mechanism includes a combination of one or more slitted structure and at least one sleeve incorporated into the cleaning substrate. The number of attachment sites between the wipe and the implement head is a matter of convenience so long as the wipe can easily and securely be fastened onto the implement head. Non-limiting examples of attachment mechanisms for securing a cleaning wipe to a cleaning implement, as well as, cleaning wipes structures suitable for use with any of the cleaning composition described herein, are discussed in copending U.S. provisional patent application Ser. No 60/499,851 to Goh et al., filed Aug. 27, 2003, and copending U.S. provisional patent application Ser. No. 60/526,628 to Lynde et al., filed Dec. 3, 2003, both assigned to The Procter & Gamble Company.

In a preferred embodiment, the disposable cleaning wipe includes at one extremity a pocket or a cavity for receiving at least a portion of the handle or the mop head of a cleaning implement. If necessary, the other extremity of the cleaning wipe can also be secured to the cleaning implement via any attachment structure or mechanism known in the art.

The implement herein can include a water-dispensing container for the water activation step and/or for the rinsing step.

The dispensing of water can occur via squeezing the container or using a trigger spray or other mechanical means, or via a battery-operated trigger. The water dispensing device bottle or container can be made of any material, including low or high density polyethylene, and be of any volume, preferably from about 50 mls to about 3,000 mls. The container and trigger mechanism, if any, can reside on the implement head or be attached, fastened or bonded to the handle. Preferably, the trigger mechanism is located, more preferably built into, the handle, most preferably at the top of the handle, for convenience to the user. Actuation of the trigger preferably results in easy dispensing of significant amounts of fluid in a stream. Preferably, the coverage on a wall for a rinsing container actuated 15 cm away from a wall is at least about 20 cm in width, more preferably at least about 30 cm in width, most preferably at least about 40 cm in width. Examples of preferred dispensing devices that can be incorporated into the implement herein include those disclosed in U.S. Pat. No. 6,540,425 and U.S. Patent Application publication No. 2003/0133740 to Policicchio et al., published Jul. 17, 2003, and assigned to The Procter & Gamble Company. The water-dispensing unit can be used in combination with a squeegee (vide infra) for fast, effective rinsing and drying of the bathtub/shower/bath wall surface.

Cleaning Composition:

In a third main embodiment of the present invention, the present invention relates to cleaning compositions, which are preferably used in the method and articles of the present invention.

The cleaning composition herein can be in paste or aqueous form and is particularly directed at soap scum and lime scale removal. There are two types: an acidic type with a pH (10% solution of said composition) of 0.5 to 6, and neutral or alkaline type, with a pH (10% solution of said composition) of about 6 to 12. Both compositions comprise at least about 5% surfactant, preferably at least about 7.5% surfactants, more preferably at least about 10% surfactants, more preferably at least about 12.5%, more preferably still at least about 15% and most preferably at least about 20% surfactants. Compositions herein preferably comprise at most about 80% surfactants, more preferably at most about 70% surfactants, more preferably still at most about 60% surfactants, and most preferably at most 50% surfactants. The preferred ranges will depend on the intended benefits (e.g., level of suds and cleaning) and cost. Any range consisting of a minimum level and a maximum level defined above can be used. However, in one highly preferred embodiment, the compositions comprise from about 25% to about 50% surfactants.

The two types of compositions are chosen to provide bathroom cleaning benefits at different pH conditions. At neutral to alkaline pH, sequestrants are effective in removing group II metals from insoluble deposits comprising soap scum, hard water and mixtures thereof. At acidic pH, sequestrants are at least partially protonated and are therefore ineffective for chelating metals. The acidifying agents, however, are effective in removing metals, especially $Ca^{++}$ and $Mg^{++}$, which are the key materials in creating soap scum and lime scale in the bathroom.

Anionic surfactants are suitable and highly desirable for use in the present invention. Anionic surfactants herein typically comprise a hydrophobic hydrocarbon chain comprising from about 8 to about 18 carbon atoms, preferably from about 8 to about 16 carbon atoms, and typically include at least one carboxylate, sulfate or sulfonate hydrophilic head group. Among anionics, those surfactants comprising sulfonate functionalities are most preferred for use herein, particularly if the pH of the composition impregnated on the wipe is less than about 3.0. Sulfonate surfactants are preferred because the sulfonate group is not susceptible to acid-catalyzed hydrolysis. Non-limiting examples of sulfonate surfactants which are suitable for the present invention include C8 sulfonate sold by Stepan under the tradename Bio-Terge® PAS-8S, $C_8$-$C_{18}$ paraffin sulfonates sold by Hoechst under tradename Hostapur® SAS, and $C_{10}$-$C_{14}$, more preferably $C_{11}$-$C_{13}$ linear or branched alkyl benzene sulfonates, available from Pilot corporation or Stepan corporation under the tradenames Bio-Soft® and Nacconol®, especially those described in U.S. Pat. Nos. 2,220,099 and 2,477,383. Other suitable sulfonates include alkyl ethoxy sulfonates and alkyl glyceryl ether sulfonates. Examples of sulfate surfactants include the C8-16 alkyl sulfates (e.g., Stepanol® AM from Stepan) and ethoxysulfates (e.g., Steol® CS series from Stepan).

Zwitterionic surfactants can also be used in the context of the present method for bathroom cleaning. Zwitterionic surfactants contain both cationic and anionic groups on the same molecule over a wide pH range. The typical cationic group is a quaternary ammonium group, although other positively charged groups like sulfonium and phosphonium groups can also be used. The typical anionic groups are carboxylates and sulfonates, preferably sulfonates, although other groups like sulfates, phosphates and the like, can be used. Some common examples of these detergents are described in the patent literature: U.S. Pat. Nos. 2,082,275, 2,702,279 and 2,255,082. Zwitterionic surfactants are beneficial particularly in the context of low pH aqueous compositions (e.g., pH 0.5-3) because they are known mildness agents that mitigate the harshness due to high acidity, particularly in the presence of anionic surfactants. A generic formula for some preferred zwitterionic surfactants is:

$$R—N^+(R^2)(R^3)(R^4)X^-,$$

wherein R is a hydrophobic group; $R^2$ and $R^3$ are each a C1-4 alkyl hydroxy alkyl or other substituted alkyl group which can be joined to form ring structures with the N; $R^4$ is a moiety joining the cationic nitrogen to the hydrophilic anionic group, and is typically an alkylene, hydroxy alkylene, or polyalkoxyalkylene containing from one to four carbon atoms; and X is the hydrophilic group, most preferably a sulfonate group. A specific example of a "simple" zwitterionic surfactant is 3-(N-dodecyl-N,N-dimethyl)-2-hydroxypropane-1-sulfonate (Lauryl hydroxy sultaine) available from the McIntyre Company (24601 Governors Highway, University Park, Ill. 60466, USA) under the tradename Mackam LHS®.

Other specific zwitterionic surfactants have the generic formula:

$$R—C(O)—N(R^2)—(CR_2^3)_n—N^2)_2^+—(CR_2^3)_n—SO_3^-;$$

wherein each R is a hydrocarbon, e.g., an alkyl group containing from about 6 to about 20, preferably up to about 18, more preferably up to about 16 carbon atoms, each ($R^2$) is either a hydrogen (when attached to the amido nitrogen), short chain alkyl or substituted alkyl containing from about 1 to about 4 carbon atoms, preferably groups selected from the group consisting of methyl, ethyl, propyl, hydroxy substituted ethyl and propyl and mixtures thereof, more preferably methyl, each ($R^3$) is selected from the group consisting of hydrogen and hydroxyl groups, and each n is a number from about 1 to about 4, more preferably about 2 or about 3, most preferably about 3, with no more than about 1 hydroxy group in any ($CR_2^3$) moiety.

Though generally classified as zwitterionic or amphoteric, betaines become more cationic as pH is lowered due to protonation of the carboxylate anionic group, and essentially function as cationic surfactants at pH below about 5. At pH of about 5 and above, betaines are zwitterionic surfactants. Betaines are highly preferred components in the present invention, because they act as excellent lathering surfactants and mildness agents. Betaines mitigate the harsh effects of anionic surfactants and this is particularly important at acidic pH. In neutral form, betaines have the structure $$R—N(R^1)_2^+—(CR_2^2)_n—COO^-,$$

wherein R is a hydrocarbon, e.g., an alkyl group containing from about 6 to about 20, preferably up to about 18, more preferably up to about 16 carbon atoms, each ($R^1$) is a short chain alkyl or substituted alkyl containing from about 1 to about 4 carbon atoms, preferably groups selected from the group consisting of methyl, ethyl, propyl, hydroxy substituted ethyl and propyl and mixtures thereof, more preferably methyl, ($R^2$) is selected from the group consisting of hydrogen and hydroxyl groups, and n is a number from about 1 to about 4, preferably about 1. In another embodiment, "amido propyl betaines' can be used, particularly in the context of compositions with pH at least about 2, more preferably at least about 2.5, and most preferably a pH of at least about 3. The preference for higher pH values stems from the potential for acid mediated hydrolysis of the amide group at low pH. These betaine surfactants can have the generic formula:

$$R—C(O)—N(R^2)—(CR_2^3)_n—N(R^2)_2^+—(CR_2^3)_n—COO^-,$$

wherein each R is a hydrocarbon, e.g., an alkyl group containing from about 6 to about 20, preferably up to about 18, more preferably up to about 16 carbon atoms, each ($R^2$) is either a hydrogen (when attached to the amido nitrogen), short chain alkyl or substituted alkyl containing from about 1 to about 4 carbon atoms, preferably groups selected from the group consisting of methyl, ethyl, propyl, hydroxy substituted ethyl and propyl and mixtures thereof, more preferably methyl, each ($R^3$) is selected from the group consisting of hydrogen and hydroxyl groups, and each n is a number from about 1 to about 4, more preferably about 2 or about 3, most preferably about 3, with no more than about 1 hydroxy group in any ($CR^3_2$) moiety. The R group can be linear or branched, saturated or unsaturated. The $R^2$ groups can also be connected to form ring structures. A highly preferred surfactant of this type is Mackam 35HP®, a coco amido propyl betaine produced by McIntyre.

Amphoteric surfactants are another class of useful surfactants in the present invention. These surfactants are similar to zwitterionic surfactants but lack a quaternary nitrogen atom. At acidic pH conditions, below about pH 5, amphoteric surfactants comprising carboxylate anionic groups function essentially as cationic surfactants. One suitable amphoteric surfactant is a C8-C16 amido alkylene glycinate surfactant ('ampho glycinate'). Another suitable amphoteric surfactant is a C8-C16 amido alkylene propionate surfactant ('ampho propionate'). These surfactants have the generic structure:

$$R—C(O)—(CH_2)_n—N(R^1)—(CH_2)_x—COO^-,$$

wherein R—C(O)— is a about C5 to about C15, pre hydrophobic fatty acyl moiety, each n is from about 1 to about 3, each R1 is preferably hydrogen or a C1-C2 alkyl or hydroxyalkyl group, and x is about 1 or about 2. Such surfactants are available, in the salt form, from Goldschmidt chemical under the tradename Rewoteric AM®. Examples of other suitable amphoteric surfactants include cocoyl amido ethyleneamine-N-(methyl) acetates, cocoyl amido ethyleneamine-N-(hydroxyethyl) acetates, cocoyl amido propyleneamine-N-(hydroxyethyl) acetates, dodecylbeta-alanine, N-alkyltaurines and analogs and mixtures thereof. N-higher alkylaspartic acids such as those produced according to the teaching of U.S. Pat. No. 2,438,091, and the products sold under the trade name "Miranol®", and described in U.S. Pat. No. 2,528,378 can also be used.

Cationic surfactants can be used in the present invention. As described herein, cationic surfactants are either surfactants that comprise a quaternary nitrogen atom, or at pH less than about 8, surfactants with primary, secondary or tertiary amine functionalities that become protonated. Additionally, betaines and amphoteric surfactants comprising carboxylate functionalities can also be classified as cationic at pH less than about 5. Cationic surfactants comprising quaternized nitrogen atoms have the structure:

$$R—N^+(R^2)(R^3)(R^4)X^-,$$

wherein R is a C8-C18 alkyl group, $R^2$ and $R^3$ are either C8-18 alkyl groups, $CH_3$, $C_2H_5$ or $CH_2OH$, $OCH_3$, $OCH_2$—$CH_3$, $CH_2$—$CH_2OH$, or $CH_2$—$C_6H_5$ and $R^4$ is either $CH_3$ or (EO)x wherein EO is an ethoxylate unit ($CH_2$—$CH_2$—O), x is from about 1 to about 12, and $X^-$ is a counterion such as $Cl^-$, $Br^-$, $HCO3^-$ $CH3SO3^-$ and the like. Examples of cationic surfactants comprising quaternary nitrogen atoms include that alkyl dialkyl dimethyl ammonium chloride surfactants available from Lonza under the tradename Bardac®, and the alkyl benzyl ammonium chloride surfactants also available from Lonza under the tradename Barquat®. Cationic surfactants formed by protonation of amines have the structure:

$$R—R—N^+(R^2)(R^3)(R^4)X^-,$$

wherein R is a C8-C18 alkyl group, R2,R3 and R4 can be H, $CH_3$, $C_2H_5$, $CH_2OH$, $OCH_3$, $OCH_2$—$CH_3$, $CH_2$—$CH_2OH$, $CH_2$—$C_6H_5$ or (EO)x where EO is an ethoxylate unit ($CH_2$—$CH_2$—O), x is from about 1 to about 12, and $X^-$ is a counterion such as but not limited to $Cl^-$, $Br^-$, $HCO3^-$ $CH3SO3^-$ and the like, with the proviso that at least one of $R^2$, $R^3$ and $R^4$ is H. An example of a suitable cationic surfactant formed by protonation of an amine is Ethomeen® C/12, a coconut based amine with the structure $C_{12}$-$C_{14}$N-EO(EO), produced and marketed by Akzo-Nobel corporation.

Nonionic surfactants can be used in the context of the present invention. Examples of preferred nonionics include alkyl ethoxylates comprising from about from about 8 carbon atoms to about 16 carbon atoms and from about one to about ten ethylene oxide moieties available from Shell Chemical under the tradenames Neodol® (North America) or Dobanol® (Europe) and from Condea under the tradename Alfonic®. Among alkyl ethoxylates, those comprising from about 8 to about 10 carbon atoms in the hydrophobic moiety and an average from about 1 to about 6 ethoxylates moieties are preferred, particularly those with "peaked" ethoxylation as disclosed in U.S. Pat. No. 5,698,041 incorporated herein by reference. Other suitable nonionics include those comprising a head group that includes at least one alkoxylate moiety that is not an ethoxylate. The alkoxylate units are typically propoxy or butoxy functionalities and can be incorporated into surfactants that additionally comprise ethoxylate groups, yielding, for example, alkyl ethoxy propoxylates. Such compounds are commercially available under the tradename Antarox® available from Rhodia and under the tradename Nonidet® available from Shell Chemical. Another class of nonionic surfactant suitable for the present invention is amine oxide. Amine oxides, particularly those comprising from about 8 carbon atoms to about 14 carbon atoms are excellent cleaning surfactants for use with the method of the present invention. Amine oxides can be purchased from Stepan corporation or the Procter & Gamble company. Also suitable for use in the present invention are the fluorinated nonionic surfactants. One particularly suitable fluorinated nonionic surfactant is Fluorad F170 (3M Corporation, 3M Center, St. Paul, Min., USA). Also suitable for use in the present invention are silicon-based surfactants. One example of these types of surfactants is Silwet L7604 available from Dow Chemical.

Other suitable nonionics include the condensation products of ethylene oxide with a hydrophobic base formed by the condensation of propylene oxide with propylene glycol are also suitable for use herein. Examples of compounds of this type include certain of the commercially available Pluronic® surfactants, marketed by BASF. Chemically, such surfactants have the structure $(EO)_x(PO)_y(EO)_z$ or $(PO)_x(EO)_y(PO)_z$ wherein EO refers to ethoxylate units, PO refers to propoxylate units, and x, y, and z are from about 1 to about 100, preferably about 3 to about 50. Other non-ionic surfactants that can be used include those derived from natural sources such as sugars and include $C_8$-$C_{16}$ N-alkyl glucose amide surfactants and $C_8$-$C_{16}$ alkyl polyglycosides (APG). Among APG surfactants, those comprising an average from about from about 8 carbon atoms to about 11 carbon atoms and a degree of oligomerization of the glycoside, preferably glucoside units of between about 1.1 and 1.8 are preferred. Examples of preferred commercially available APG surfactants include Glucopon® 225, Glucopon® 425, APG 325®, Plantaren® 2000 N UP and Plantacare® 818 available from Cognis corporation. Still other suitable though not preferred non-ionic surfactants include the polyethylene oxide condensates of $C_8$-$C_{12}$ alkyl phenols with ethylene oxide, said ethylene oxide being present in amounts equal to about 10 to about 25 moles of ethylene oxide per mole of alkyl phenol.

In a preferred embodiment of the invention, the compositions are acidic. The pH of acidic compositions for use herein is from about 0.5 to about 6, more preferably from about 1.5 to about 5.5, most preferably from about 2 to about 4.5. When the pH is between about 0.5 and about 2, it is preferred that the wipes be used in combination with an implement so as to minimize skin exposure.

When acidic, the chemical compositions comprise at least about 3%, more preferably at least about 5%, still more preferably at least about 6%, still more preferably at least about 8% and most preferably at least about 10% acidifying agents. Additionally, the compositions comprise at most about 80%, more preferably at most about 70%, more preferably at most about 60%, more preferably still at most about 50% and most preferably at most about 40% acidifying agents. The preferred ranges will depend on the intended benefits (e.g., scale removal vs. body soil removal), level of surface safety and cost. Any range consisting of a minimum level and a maximum level defined above can be used. In one highly preferred embodiment, the acidifying agents comprise from about 12.5% to about 30% by weight of the composition. The acidic compositions preferably comprise at least one acidifying agent selected from the group consisting of acetic acid, adipic acid, aspartic acid, ascorbic acid, fumaric acid, glutaric acid, glycolic acid, hydrochloric acid, iminodiacetic acid, iminodisulfuric acid, lactic acid, maleic acid, malic acid, malonic acid, nitric acid, oxalic acid, phosphoric acid, salicyclic acid, sorbic acid, succinic acid, sulfuric acid, sulfurous acid, tartaric acid, and combinations thereof. Highly preferred organic acids are selected from the group consisting of adipic acid, glutaric acid, succinic acid, lactic acid, maleic acid and citric acid and combinations thereof. For cost, availability, buffering capacity and regulatory reasons, citric acid (food grade desired but not required) and the combination of Acidic, Glutaric and Succinic acids (AGS) commercially sold by Rhodia corporation and Dupont corporation are most preferred. Preferred inorganic acids for the invention are phosphoric acid and sulfamic acid. Organic and inorganic acids can be combined into the same paste or aqueous composition as desired or needed. Combinations of maleic acid and phosphoric acid, maleic acid and citric acid, citric acid and phosphoric acid, AGS and maleic acid, AGS and phosphoric acid, AGS and citric acid, and any of these individual acids or combinations with sulfamic acid are particularly effective and therefore preferred for the combined cleaning of lime scale and soap scum.

In another embodiment of the method of the invention, the compositions have a pH (10% solution of said composition) from about 6 to about 12. These compositions comprise sequestrants.

Sequestrants are materials known to bind to metals, especially group II metals, most especially $Mg^{++}$ and $Ca^{++}$ ions. Sequestrants are preferably used at levels of at least about 3%, more preferably at least about 5%, more preferably at least about 10%, more preferably still at least about 15%, and most preferably at least about 20% by weight of the composition. Additionally, sequestrants are preferably used at levels of at most about 70%, more preferably at most about 60%, more preferably still at most about 50% and most preferably at most about 40% by weight of the composition. Phosphorus-based sequestrants such as aminopolyphosphonates, particularly ethylenediamine tetramethylene phosphonate, hexamethylene diamine tetra methylene phosphonate and diethylene triamine pentamethylenephosphonate can be used. Many aminopolyphosphonates are available from Monsanto corporation under the tradename Dequest®. Alternatively, phosphorus-containing builders, especially the sodium and potassium salts of phosphoric acid can be used. More preferably, the sequestrants are not phosphorus based. One class of sequestrants includes oligomers and polymers comprising polycarboxylic acids. For example, butane tetracarboxylates, oxidisuccinates and mixtures of tartrate succinic acid and tartrate disuccinic acids such as described in U.S. Pat. No. 4,663,071, salts of polyacrylic acid and polymethacrylic acid, polymers and copolymers comprising acrylic acid and methacrylic acid monomers or their salts can all be used as sequestrants. Still more preferably, the sequestrant is selected from the group consisting of amino polycarboxylic acids. Examples of sequestrants based on aminopolycarboxylic acids include those of general formula:

$$A\text{-}N(A)\text{-}CH_2\text{—}CH_2\text{—}N(A)\text{-}B,$$

wherein A represents $\text{—}CH_2\text{—}COOH$ or $\text{—}CH_2CH_2\text{—}COOH$, and B represents $CH_2\text{—}COOH$, $\text{—}CH_2CH_2\text{—}OH$, $\text{—}CH_2CH_2\text{—}N(CH2\text{-}COOH)_2$, or $\text{—}CH_2CH_2\text{—}N(CH_2\text{—}COOH)\text{—}CH_2CH_2\text{—}N(CH2\text{-}COOH)_2$. In each case, the carboxylic acids are preferably at least partially, more preferably fully neutralized for the sequestrants to be most effective. Neutralizing cations are those known in the art, for example, sodium, potassium, ammonium and alkanolammonium, especially ethanolammonium and triethanolammonium. Polymeric aminocarboxylic acids can also be used, especially polyaspartic acid and associated salts. Preferred sequestrants include nitrilotriacetic acid (NTA), methylglycine diacetic acid (MGDA), ethylene diamine tetraacetic acid (EDTA), N-hydroxyethyl ethylene diamine triacetic acid, diethylene triamine pentaacetic acid (DTPA), ethanol diglycine, ethylenediamine dissuccinic acid (EDDS, see U.S. Pat. No. 4,704,233) and salts and mixtures thereof. Most preferred are the sodium, potassium, ammonium and alkanolammonium (especially ethanolammonium and triethanolammonium) salts or partial salts (incomplete neutralization of the acid form of the sequestrant) of NTA, MGDA and EDTA.

In a highly preferred embodiment, neutral to alkaline pH compositions are in paste or aqueous form at a pH from about 7 to about 11, and comprise at least 10%, more preferably at least about 15%, more preferably at least about 20%, more preferably still at least about 25%, most preferably at least about 30% surfactant, and at least about 10%, more preferably at least about 15%, most preferably at least about 20% of one or more sequestrants selected from the group consisting of sodium, potassium or ammonium nitrilo triacetate, sodium, potassium or ammonium methyl glycine diacetate, trisodium, tripostassium or triammonium ethylene diamine, and tetrasodium, tetrapotassium or tetraammonium ethylene diamine, and mixtures thereof. The above compositions can optionally comprise from about 0.1% to about 5% of a precipitating co-builder as described in U.S. Pat. No. 6,245,728, including potassium carbonate and potassium oxalate for additional soap scum removal.

The compositions, whether acidic, neutral pH or alkaline, preferably include at least one or more hydrotropes. When present, hydrotropes are present at a level of at least about 3%, more preferably from about 3% to about 40%, more preferably from about 5% to about 30%, more preferably still from about 7.5% to about 30% and most preferably from about 10% to about 25% by weight of the composition. Hydrotropes can fulfill many important functions within the scope of the compositions of the present method. First, they help reduce the packing of surfactants. This is believed to help the composition suds profile by curbing suds longevity, and improving rinsing. Reduced surfactant packing also assists the kinetics of water activation, allowing the water to more quickly penetrate, dissolve and release surfactant monomers and other actives including solvents. This is believed to be beneficial, as faster release of actives results in longer dwell time of the actives on the soiled surfaces during the cleaning process leading to better results. As used herein, hydrotropes are preferably selected from the group consisting of toluene, xylene and cumene sulfonate salts available from Ruegers-Nease corporation under the tradename Naxonate®, hexyl-, decyl- and dodecyl-diphenyl ether disulfonate salts available from the Dow chemical company under the tradename Dowfax®, C4-C6 and C8 alcohol ethoxylates available from Condea corporation under the tradename Alfonic®, C4-C6 alkyl glucosides available from Seppic corporation, 2-ethyl-1-hexyl sulfate salts available from Rhodia corporation under the tradename Rhodapon®, mono- and di-(2-ethyl-1-hexyl sulfosuccinate salts) available from Cytec industries under the tradename Aerosol®, and C8-C22 alkyl ethoxylates having an HLB greater than about 12 available from Hunstman corporation under the tradename Surfonic® (e.g., Surfonic L24-22); and mixtures thereof.

The composition herein also preferably includes one or more organic cleaning solvents. As used herein, organic cleaning solvents are those chemical compounds that exist as liquids at 25° C. and comprise at least four carbon atoms. The level of solvent in the compositions herein is preferably from about 1% to about 40%, more preferably from about 3% to about 30%, still more preferably from about 5% to about 25%, most preferably from about 5% to about 20% by weight of the cleaning composition. Organic cleaning solvents include hydrocarbon-based solvents, $C_6$-$C_{10}$ esters, organic diols and glycol ethers. Examples of hydrocarbon-based solvents include α-pinene, β-pinene, d-limonene, C8-C20 paraffins and isoparaffins such as those sold by Exxon under the tradename Isopar®. Examples of preferred diols include 1,2-hexanediol, 1-2-octanediol and 2-ethyl-1,3-hexanediol. Examples of preferred esters include the C8 and C10 methyl, ethyl, propyl and butyl esters; for example a highly pure C10 methyl ester is available from the Procter & Gamble company under the tradename CE-1095®. In a preferred embodiment, at least one glycol ether solvent is incorporated in the compositions of the present invention. Preferred glycol ethers have a terminal C3-C8 hydrocarbon attached either to from one to three ethylene glycol moieties or to from one to three propylene glycol moieties to provide the appropriate degree of hydrophobicity, wetting and surface activity. Most preferred for use in the compositions of the present invention are glycol ether solvents that comprise either one ethylene or two ethylene oxide moieties and a C4-C6 terminal alkyl chain, or two to three propylene oxide moieties and a C3-C8 terminal chain. Examples commercially available preferred glycol ether solvents include tripropylene glycol methyl ether, dipropylene glycol n-butyl ether, dipropylene glycol n-propyl ether, tripropylene glycol n-butyl, tripropylene glycol n-propyl ether, ethylene glycol n-hexyl ether and diethylene glycol n-hexyl ether, all available from Dow Chemical. Another preferred glycol ether is ethylene glycol 2-ethyl-1-hexyl ether available from Eastman chemical under the tradename EEH® solvent.

The compositions can optionally include one or more polymers for additional benefits. These include hydrophilic water sheeting polymers to prevent soil build up, soil release polymers to reduce adhesion of soils on hard surfaces, and shine or gloss polymers to enhance the visual appearance of surfaces. Preferred polymers include naturally occurring polysaccharides such as xanthan gum, guar gum, locust bean gum and synthetic polysaccharides such carboxymethylcellulose, ethyl cellulose, hydroxyethyl cellulose, hydroxypropyl cellulose. Other suitable polymers include those derived from N-vinyl pyrrolidone, including polyvinyl pyrrolidones (10,000 to 200,000 molecular weight) and copolymers formed by reacting N-vinyl pyrrolidone with either acrylic acid, methacrylic acid, itaconic acid, caprolactam, butene or vinyl acetate. Still other suitable polymers comprise amine oxide and sulfonate functionalities, such as polyvinyl pyridine-N-oxide (1,000 to 50,000 molecular weight), polyvinyl sulfonate (1,000 to 10,000 molecular weight), and polyvinyl styrene sulfonate (5,000 to 1,000,000 molecular weight). Other preferred polymers include those amphoteric copolymers derived from DADMAC/acrylic acid/acrylamide copolymer, DADMAC/maleic acid copolymer, and DADMAC/sulfonic acid copolymer described in U.S. Pat. No. 6,593,288, incorporated herein by reference. These polymers provide excellent water sheeting and are found to enhance the shine of enamel and other surfaces. Yet other classes of suitable polymers include polyethylene glycols (5,000 to 5,000,000 molecular weight), modified polyethylene imines such as Lupasol SK sold by BASF (100,000 to 5,000,000 molecular weight). Most preferred are polystyrene sufonate (10,000-80,000 molecular weight), polyvinyl pyridine N-oxide (2,000-30,000), polyvinyl pyrrolidone (30,000 to 100,000 molecular weight), and DADMAC/acrylic acid/acrylamide polymers sold by Rhodia under the tradename Mirapol® HSC-300.

The compositions can include one or more abrasive agents. When present, the abrasive agents comprise from about 8% to about 50%, more preferably from about 10% to about 40%, most preferably from about 15% to about 35% by weight of the composition. Inorganic abrasives are preferably selected from the group consisting of quartzes, siliceous chalk, diatomaceous earth, and colloidal silicon dioxide. Organic abrasives are selected from the group consisting of polyethylenes, polypropylenes, polyesters, polystyrenes, polycarbonates, polyacetals, urethane resins, melamine and mixtures thereof. The particle size of these abrasives is preferably from about 10 microns to 200 microns, more preferably from 20 microns to 100 microns, and most preferably from about 25 microns to about 75 microns. Examples of suitable abrasives are disclosed in U.S. Pat. No. 6,458,753 incorporated herein by reference.

Small amounts of adjuncts can be added to improve the cleaning performance of the wipe. These include lower alcohols, including ethyl alcohol, isopropyl alcohol and the like. Thickeners can be included, especially xanthan gum, guar gum and high molecular weight crosslinked polycrylate derivatives sold by the BF Goodrich company under the tradename Carbopol®. Enzymes can be included, especially in the paste product in which they can be protected until the wipe is water activated. Antibacterial agents, including quaternary ammonium compounds, chlorhexidine salts (diacetate and digluconate) and poly(hexamethylene biguanide) and salts thereof (e.g., hydrochloride) can also be incorporated herein. Aesthetic adjuncts such as buffers, dyes and perfumes are also preferably included.

Paste Compositions

Compositions in paste form are highly preferred in both embodiments of the cleaning compositions herein. The pastes can be manufactured, sold and marketed in containers so that the user can dip into the container and apply some of the contents directly to hard surfaces using, for example, synthetic or cellulose-based sponges, chamois, cloths, rags, scouring pads, paper towels, and the like. The paste can also be preloaded onto any of the cleaning carriers above (especially melamine structures), or be incorporated into films or inside pouches made of polyvinyl alcohol (partially or completely hydrolyzed polyvinyl acetate), polyvinylalcohol-acrylic copolymer, polyvinyl pyrrolidone, hydroxypropyl methyl cellulose, quaternized protein hydrosylates, quaternized polyamines, or other water soluble materials.

More preferably the paste is loaded onto the face of one or more nonwoven substrates preferably nonwoven substrates with a basis weight of about 20 g/m$^2$ to about 200 g/m$^2$, and a density of at least 0.15 g/cm$^3$ that are in facing relation to each other and bonded to each other, creating a single use disposable cleaning wipe. Preferably the paste is not loaded on the edges of the substrate so as to not interfere with the bonding of the nonwoven substrates.

When the cleaning composition is in a paste form and is loaded onto the disposable wipe, the cleaning efficiency of the wipe can be impacted by the amount of paste capable to reach the cleaning outer surface of the wipe.

In one embodiment, the single use disposable wipe comprises an average of at least about 0.005 g of cleaning paste per square cm of cleaning wipe area, preferably an average of at least about 0.010 g/cm$^2$, more preferably an average of at least about 0.015 g/cm$^2$, and most preferably an average of at least about 0.020 g/cm$^2$. The average amount of cleaning paste per square cm of cleaning wipe area can be calculated by weighting the total amount of paste in the cleaning wipe and measuring the area of the cleaning side of the wipe and then by dividing the total amount of paste by the area measured. For a cleaning wipe which is generally two dimensional (i.e. the Z dimension is substantially negligible relative to the X and Y dimensions of the wipe), it will be understood that by "cleaning side" it is meant the side of the wipe from which the paste can be dispensed and applied on the surface to be cleaned during the cleaning operation. It will be understood that in the event both sides of the wipe are usable for cleaning, only one of the cleaning side area is to be used to calculate the average amount of cleaning paste per square cm of cleaning wipe area.

In one embodiment, the single use disposable wipe has an average amount of cleaning paste per square cm of cleaning wipe area of less than about 0.60 g/cm$^2$ preferably of less than about 0.40 g/cm$^2$, more preferably of less than about 0.30 g/cm$^2$, and most preferably of less than about 0.25 g/cm$^2$. In an even more preferred embodiment, the average paste content is between about 0.025 g/cm$^2$ and about 0.20 g/cm$^2$. In one embodiment, the total weight of cleaning paste on the cleaning wipe is from about 3 grams to about 100 grams, more preferably from about 5 grams to about 75 grams, most preferably from about 7 grams to about 60 grams.

It is highly beneficial to build advantageous rheological properties into the paste so as to maximize the flow of paste to the surface to be cleaned and encourage speedy dissolution of the paste to form concentrated solutions for cleaning. It is useful that the paste display substantial viscoelastic properties and have liquid-like properties upon the placement of an oscillatory shear stress on the paste. When measured over the linear viscoelastic region at a frequency of 10 s$^{-1}$, the paste preferably has a storage modulus, G' (solid like stiffness) of from about 5000 Pa to about 50000 Pa, more preferably from about 7500 Pa to about 40000, most preferably from about 7500 Pa to about 30000 Pa, and a loss modulus, G" (liquid-like stiffness) in the range of from about 1000 Pa to about 10000 Pa, more preferably from about 1500 Pa to about 8000 Pa, most preferably from about 2000 Pa to about 7000 Pa. The relaxation time, defined as the cross-over point between G' and G" in a experiment where the viscosity is plotted versus frequency at a constant shear stress is preferably less than about 1 Hz, more preferably less than about 0.5 Hz, most preferably less than about 0.1 Hz at 25° C. All rheology measurements are conducted on a Rheolyst Series AR 2000 rheometer style A, manufactured by T.A. Instruments, Ltd., Europe House, Bilton Centre, Cleeve Road, Leatherhead, Surrey KT22 7UQ, United Kingdom.

Paste compositions require hydrotrope or solvent. In one highly preferred embodiment, the pastes comprise at least about 3% of one or more hydrotropes (see section on hydrotropes for specific disclosures applicable to paste or aqueous product forms). In addition to the benefits already described in the section on hydrotropes, hydrotropes can provide or enhance the liquid-like (G") properties of the paste, thereby assisting the transfer of cleaning actives to the soiled surface. Hydrotropes also assist in the processing or manufacturing, particularly for pastes, ensuring easier blending of components and more fluid processing conditions. As such, hydrotropes are surprisingly important components of the detergent pastes of the invention.

In another preferred embodiment, the pastes comprise at least 1% of one or more organic cleaning solvents, more preferably more than 1% organic cleaning solvents (see section on solvents additional solvent disclosures pertinent to compositions in paste or aqueous form). Preferably, the organic cleaning solvent has a solubility of less than about 10%, more preferably less than about 7%, most preferably less than about 5% in water at 25° C. In a particularly preferred embodiment, solvent is incorporated into the paste at a concentration that exceeds the solvent water solubility limit at 25° C. It is found that this can be achieved with the pastes of the present invention, in direct contrast to aqueous compositions, even concentrated aqueous compositions, for which water solubility limits define chemical instability points, placing an upper limit on permissible solvent concentration.

Since hydrophobic solvency is believed to assist removal of highly insoluble soils such as soap scum, the flexibility to include high levels of hydrophobic solvent without concern for product or phase instability provides an enormous advantage to the pastes of the invention for delivering more cleaning power to hard surfaces, especially bathroom surfaces including bathtub and shower enclosures. Other hard surface cleaning applications that can benefit from the use of pastes comprising solvents at a concentrations exceeding the water solubility limit include kitchen countertops, pots and pans, ovens, stovetops, and range hoods, toilet bowls, car exteriors, garage floors (e.g., concrete), grills, walkways, driveways, outdoor windows, house siding and the like.

The pastes preferably comprise at least one surfactant selected from the group consisting of zwitterionic and amphoteric surfactants (see section on surfactants for disclosure of zwitterionic and amphoteric surfactants that can be used in paste or aqueous form). These surfactants, in addition to providing good lather, mitigate the harshness of other surfactants, particularly anionic surfactants. The benefits are especially important at extreme pH conditions, such as pH (10% solution of paste) from about 0.5 to about 2.5. Most preferred among the zwitterionic or amphoteric surfactants are lauryl and coconut based betaines and sulfobetaine derivatives. Especially preferred are those betaine surfactants comprising a low halogen salt content, preferably less than about 0.15 g salt per gram of betaine active, more preferably less than about 0.10 g salt per g, most preferably less than about 0.05 g salt per g betaine active. Preference for low halogen salt content is dictated by the desire to minimize the corrosion due to salts such as sodium chloride, potassium chloride, sodium bromide and potassium bromide and the like.

Pastes for cleaning soiled bathroom surfaces can advantageously be formulated at low pH with less concern for human safety than corresponding aqueous compositions. This is because the paste product form does not easily permeate across the stratum corneum of the skin. Accordingly, acidic pH pastes can advantageously be prepared at pH (10% solution) as low as about 1.0, more preferably as low as about pH 1.5, most preferably as low as about pH 2.0 with less risk for human exposure issues. For these compositions, it is highly preferable to include an amphoteric or zwitterionic surfactant for improved skin mildness.

The pastes of the present composition surprisingly can include chemicals that are thermodynamically unstable with respect to chemical decomposition in aqueous medium. Thus, chemical raw materials including surfactants and solvents that comprise functional groups including esters or amides can be stabilized at low pH, below about pH 4 by the paste product form; additionally, anionic sulfate surfactants are found to be surprisingly stable in acidic compositions that are in paste form and are less susceptibly to hydrolysis than is observed when present in aqueous compositions.

The paste form has several advantages: the paste form comprises less water, enabling incorporation of higher cleaning actives on the cleaning wipe. That is, pastes can hold higher levels of organic cleaning solvent, and can more easily coexist with aggressive chemistries, including bleaches (vide infra). The paste can conveniently be extruded or added onto or near a cleaning side of the wipe, maximizing the release of concentrated product onto the surface to be cleaned following water activation. Pastes do not diffuse well into the substrate. A paste form also connotes a richer, stronger product. Moreover, the paste can be loaded on a nonwoven substrate so that it can be easily visible to the user. For example, colored paste strips, dots or company/brand logos throughout the outer surface of a nonwoven provide an appealing visual signal of the cleaner's presence. Mr. Clean®, Clorox® or Scrubbing Bubbles® icons, for example, can be inscribed on the nonwoven substrate by means of paste in one or more colors. Thus, the paste product form provides greater flexibility for aesthetic appeal and differentiation than an impregnated aqueous composition.

In a preferred embodiment, the cleaning operation is conducted using two or more separate cleaning compositions wherein at least one is a paste, and the two compositions are brought together during the cleaning operation. The second, third or other compositions can also be in the form of a paste or a solid, or be a gel, a tablet or water soluble pouch, an isotropic aqueous composition, a microemulsion, or an emulsion. When the second composition is an aqueous, it is preferable that it either be encapsulated in a pouch or the like, or that it be present in the pre-moistened wipe at a level not sufficient level to fully saturate the substrate layer onto which it is impregnated. One of the reasons for separating the two or more compositions prior to the point of use is to allow the benefits of each of the compositions to take place at slightly different times during the cleaning operation. For example, a first paste composition can comprise surfactant, sequestrant and hydrotrope, and a second aqueous composition can comprise polymer for surface sheeting and soil release benefits. The paste and aqueous compositions can be incorporated into the same cleaning carrier, for example, a cleaning wipe. By incorporating the paste on the outermost layer of the cleaning wipe and the polymer composition on an inner layer of the same cleaning wipe, the paste is used first, and the polymer composition can essentially function as a finishing step to provide a surface free of streaks and spots during the rinse step of the cleaning operation.

In a highly preferred embodiment, the paste compositions herein additionally comprise one or more bleaches or bleach precursors for antimicrobial (bacteria, viruses) and antifungal benefits. Additionally, inclusion of bleach in the cleaning wipes of the present invention is highly advantageous because it provides a means for treating simultaneously treating soap scum, lime scale and mold/mildew all in a single product. This is in direct contrast to currently marketed aqueous bathroom cleaning that can tackle at most two of the three soils because of either chemical incompatibility or safety issues. Bleaches are not stable in acidic aqueous compositions except at very low pH where safety issues are a concern. At alkaline pH, non phosphorus-based sequestrants needed for hard water and soap scum removal are incompatible with bleach. As a result, at all pH conditions, aqueous-based compositions carry significant tradeoffs; it is now found that the formulation tradeoffs can be completely eliminated by the paste compositions and articles of the present invention.

The bleach or more preferably bleach precursor, can be optionally incorporated directly into the paste compositions. Indeed, the paste product form, particularly at low water content, is found to stabilize the bleach and/or precursor until the time of use. Alternatively, bleach can be incorporated into the cleaning wipe and can be intentionally separated from the surfactant paste. For example, the bleach or bleach precursor can be included as a solid, gel, paste, tablet, or water soluble pouch or film as described heretofore, an aqueous composition or an emulsion on a different nonwoven layer of the cleaning wipe than the one comprising the surfactant-containing paste, such that it does not contact the surfactant paste prior to use. If desired, one of more nonwoven layers can separate the paste from the bleach. When the bleach is an aqueous form, it is preferable that it either be encapsulated in a pouch or the like, or that it be present in the pre-moistened wipe at a level not sufficient level to fully saturate the substrate layer onto which it is impregnated. If the bleaching agent is in solid form, it is preferably encased between nonwoven layers such that it can not migrate to the layer comprising paste. This can be achieved by controlling the density of the substrates into which the cleaching agent is encased.

When present, bleach and/or bleach precursors comprise at least about 0.1%, more preferably at least about 0.5%, more preferably still at least about 1%, more preferably still at least about 3%, and most preferably at least about 5% by weight of the total chemical composition in the cleaning wipe; bleach and/or bleach precursors comprise at most about 40%, more preferably at most about 30%, most preferably at most about 20% bleaching agents. The exact amount of bleach or bleach precursor preferably included is a matter of formulation choice and will depend on the importance attached to which of the benefits sought and on cost. Any range comprising the above-disclosed lower and upper limits can be used.

Examples of suitable acidic bleaching agents include inorganic peroxides such as hydrogen peroxide, and sources thereof (e.g., per carbonate, per borate), persulfate salts (dipersulfate and monopersulfate salts and monopersulfate salts such as the triple salt 2KHSO5.KHSO4.K2SO4 sold by DuPont under the tradename Oxone®), persulfuric acids and combinations thereof. Examples of suitable organic peroxides are benzoyl peroxide and peracids, including peracetic acid, perpropionic acid, perhexanoic acid and phthalimide percarboxylic acids including 6-phthalimide perhexanoic acid (PAP) described in European Patent No. 0 349 940 incorporated by reference herein.

Among preferred acidic bleaches are hydrogen peroxide, and monopersulfate. Hydrogen peroxide is easily incorporated into the paste product form and can be advantageously included into the cleaning wipe along with or more transition catalysts, especially manganese dioxide, silver and transition metal oxo-anions such as those described by J A Connor and E V A Ebsworth in *Adv. Inorg. Chem. Radiochem.* 6 (1994), pp 279-381 and by M H Dickman and M T Pope in *Chem. Rev.* 94, (1994), pp 569-584. In one embodiment, hydrogen peroxide, either as is or in the form of percarbonate or perborate, is incorporated into the paste and the transition metal catalyst, preferably manganese dioxide or a molybdate and/or tungstate, is incorporated into the cleaning wipe separately so that the two entities (i.e., paste comprising hydrogen peroxide and transition metal oxo-anions) do not contact each other. Bleaching can also be achieved using monopersulfate (e.g., Oxone®) either with or without a ketone. The monopersulfate salt, in combination with a ketone such as acetone will form a dioxirane:

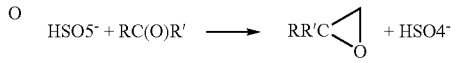

Dioxirane can oxidize ethylenically unsaturated molecules and in the cleaning operation, regenerating the ketone. As such, only low levels of ketone are necessary. When present, the ketone is preferably not in direct contact with the monopersulfate. That is, either the ketone or the monopersulfate is incorporated into the paste, and the other component is not in direct contact with the paste. For example, the paste can comprise 1-4% acetone and the monopersulfate can be added as a solid to a nonwoven layer that is not in contact with the paste. Alternatively, the paste comprising one or more ketones comprises one set of strips on the nonwoven and the monopersulfate lies in between strips or forms another set of strips that do not directly contact the paste strips prior to use.

Among preferred bleaching agents or precursors for use in neutral pH or alkaline compositions are selected from the group consisting of percarbonates, perborates, peracid salts and mixtures thereof. In one preferred embodiment, the bleaching agent is of the type that yields hypobromite ions or hypochlorite ions, most preferably hypochlorite ions. Bleaching agents that yield hypochlorite ions by contact with water include alkali metal and alkaline earth metal hypochlorites, hypochlorite addition products, chloramines, chloramines, chloramides and chlorimides. Specific examples of preferred compounds for use herein include sodium dichloroisocyanurate, potassium dichloroisocyanurate, N-chlorosulfamide and 1,3-dimethyl hydantoin. Most preferred is sodium dichloroisocyanurate.

When present, the hypobromite or hypochlorite bleaching agent is preferably separate from the paste-containing composition and the paste containing composition optionally comprises sulfamic acid, especially if the pH of the combined paste+bleaching agent composition is below about pH 10. Sulfamic acid is known to mitigate the formation of bromine liquid or chlorine gas from hypohalites, and reduce the malodor caused by these bleaches upon contact with human skin. Another highly beneficial bleach for use at neutral to alkaline pH is 6-phthalimide perhexanoic acid (PAP). Preferably, PAP is kept separate from the paste composition, preferably at a pH of from about 1.5 to about 3.5, such that upon mixing with the paste during the cleaning operation, the pH of the combined materials is from about 6 to about 9.

The paste compositions herein can also include fillers. Fillers can include abrasives discussed previously, as well as salts including sodium sulfate and sodium carbonate, and fumed silica, kaolin, zeolites, siliceous chalk, diatomaceous earth, natural clays including montmorillonite, hectorite, and the like. The purpose of fillers is to lower the cost of paste compositions. Salts such as sodium sulfate are the most preferred filler because of low cost and worldwide availability. Additionally, salts can advantageously be employed to absorb water and create pastes with good physical properties. Excessive use of fillers, however, will result in compositions that are acceptable but not preferred embodiments of the water activation method disclosed herein. When present, non-abrasive fillers preferably comprise at most about 40%, more preferably at most 30%, still more preferably at most 20% and most preferably at most about 10% by weight of the composition.

Aqueous Compositions

The aqueous compositions for use with the method disclosed herein are preferably isotropic, or nearly isotropic compositions. Examples of preferred acidic aqueous cleaning compositions for the cleaning of lime scale that additionally provide some soap scum cleaning and can be used with the method of the present invention include those disclosed in U.S. Pat. Nos. 5,686,399, 5,677,271, 5,981,449, 6,001,792, 6,127,330 and 6,551,985, all incorporated herein by reference. Examples of preferred aqueous cleaning compositions for soap scum and that additionally provide some lime scale benefits and can be used with the cleaning wipes and method of the present invention include those disclosed in Great Britain Pat. No. 2,385, 597 and U.S. Pat. Nos. 5,061,393, 5,192,460, 5,384,063, 5,612,308, 5,698,041, 5,912,219, 5,981,455, 6,180,583 and 6,627,590, all incorporated herein by reference. One skilled in the art will appreciate that compositions from patents that are primarily directed to the cleaning of hard water can be combined with compositions from patents primarily directed at the cleaning of soap scum. Examples of preferred aqueous neutral pH or alkaline pH compositions that can be used with the method of the present invention include those disclosed in U.S. Pat. Nos. 4,020,016, 5,814,591, 5,948,742, 5,972,876, 6,004,916, 6,214,784, 6,399,555, Great Britain Patent No. 2,231,580, and International publication WO 98/50510. The compositions disclosed in U.S. Pat. Nos. 5,814,591, 5,948,742, 5,972,876, 6,004,916, 6,214,784, and 6,399,555 are especially useful for the methods of the invention since these patents disclose high performance aqueous bathroom cleaning compositions comprising surfactant, organic cleaning solvent, and specific salts of EDTA. U.S. Pat. Nos. 6,245,728 and 6,399,555 additionally comprise precipitating cobuilders such as potassium carbonate to further enhance the cleaning of soap scum. Even more preferably, increased levels of surfactant, greater than about 25% by weight of the chemical composition, increased levels of EDTA sequestrant, greater than about 15% by weight of the composition are highly preferred for the aqueous compositions herein, especially when used with the water activation method of this invention.

The aqueous compositions for use with the method described herein can be in the form of microemulsions. Examples of microemulsion compositions to be used in conjunction a cleaning wipes and the method herein disclosed include U.S. Pat. Nos. 5,235,614, 4,46,499 and 4,472,291, which disclose microemulsions comprising hypochlorite bleach for the cleaning of mold, and U.S. Pat. Nos. 5,108,643, and 5,076,954, which describe microemulsions, which in acidic form, are useful for the cleaning of lime scale and soap scum. Other patents that can provide benefits with the method of the present invention include U.S. Pat. No. 6,017,868, U.S. Pat. No. 5,854,193 and U.S. Pat. No. 5,861,367. All patents described above are incorporated by reference.

Aqueous compositions to be used with the method of the invention can be made in the form of a liquid crystal. Relevant acidic liquid crystal compositions for cleaning bathroom surfaces are have been described in the art in U.S. Pat. No. 5,035,826, U.S. Pat. No. 5,035,826 and U.S. Pat. No. 5,523,013, all incorporated herein by reference. Detergent gels in predominantly hexagonal phase gel can also be used. Such gels can be made to be transparent, translucent or opaque and are described in D G Hall and G J T Tiddy "Anionic surfactants: physical chemistry action" (Volume of Surfactant Science Series) ed. E H Lucassen-Reynders, Marcel Dekker, New York, 1981, Chapter 2, pages 91-94, incorporated herein by reference. Among hexagonal phase gels, those formed by addition of high levels of additives such as urea, cumene, xylene and toluene sulfonate to compositions comprising anionic sulfonates and alkyl ethoxy sulfates are particularly useful. Such gels are disclosed in U.S. Pat. No. 4,615,819 and U.S. Pat. No. 5,320,783 incorporated herein by reference. As desired, the hexagonal phase gels in these U.S. patents can formed with from about 10% to about 40% hydrotropes such as toluene, xylene and cumene sulfonate, and acidified with from about 5% to about 40%, more preferably from about 5% to about 30%, most preferably from about 5% to about 25% inorganic acid, organic acid, and mixtures thereof.

Composition Making:

The compositions herein are made by the mixing the components together. The order of addition for the components is not critical when the compositions are in aqueous form, especially isotropic liquids. For emulsions, microemulsions and gels, order of addition will depend on the specific compositions. When the compositions are in the form of a paste, the paste can be formed either starting from aqueous ingredients that are first mixed together than then dried, or from predominantly solid ingredients to which water is added. Preferably, the order of addition is chosen so as to keep the compositions as fluid as possible during the making process. Preferably, those components that are least stable in aqueous media are added close to last during the making process to minimize potential decomposition.

In one embodiment, the paste compositions herein exhibit good flow properties under shear during the making operation. As made, the compositions preferably are not very viscous, with an initial viscosity of from about 10 Pa·s to about 75 Pa·s, more preferably from about 20 Pa·s to about 50 Pa·s at a shear rate of 1 $s^{-1}$, that increases when the compositions are left unperturbed (i.e., continuous mixing is stopped) for several hours. It is found that such processing benefits are realized in certain cases, for example, when the paste is acidic and comprises alkyl benzene sulfonate surfactant. Such rheological properties allow for easier manipulation of the pastes prior to additional processing, such as shipping, transfer to other containers and the like.

EXAMPLES

The following examples are provided to illustrate the article and paste of the invention. They should not be construed to be limiting.

Paste #1: To 281.04 grams of water, 400 g maleic acid (99% active, Aldrich), 0.080 g blue dye (100% active), 200 g citric acid (100% active, Lyle & Tate) and 200 g ethylene glycol n-hexyl ether (100% active Hexyl Cellosolve®, Dow Chemical) are sequentially added in a 2-gallon pail and continuously blended using an RW 20 DZ.n mixer made by Ikatechnik and marketed by Divtech Equipment co. (P.O. Box 58468, Cincinnati, Ohio 45258). Once the solid acids are well blended and substantially dissolved, 800 grams of cumene sulfonate powder (93% active, Ruetgers-Nease corporation) are added. Upon continuous blending at 1,500 rpm, the composition becomes homogeneous, and 70 g perfume (100% active, Avanel), 78.16 g water sheeting polymer (20.5% active, polyzwitterionic polymer 'Mirapol HSC-300', Rhodia) and 948.45 g lauramidopropyl betaine (Mackam 1200, McIntyre) are sequentially added to the mixture. Upon continuous blending at 1,500 rpm, the composition again becomes homogeneous, and 742.27 grams of sodium dodecyl sulfate (97% active, Stepan) are added. Addition of the sodium dodecyl sulfate causes the composition to thicken considerably. The final paste weighs 4 kilograms.

Paste #2. An acidic paste is made, except that the sodium dodecyl sulfate active in paste #1 is substituted with an equivalent active amount of linear alkyl benzene sulfonate (Nacconol 90G, 95% active, Stepan). Addition of the sulfonate surfactant does not result in a thickening of the paste under shear, and the final composition (4 kg) flows easily. A lid is applied to the paste container and the paste is stored overnight. Upon inspection of the paste on the next day, it appears visually much thicker.

All rheological measurements are conducted on a Rheolyst Series AR 2000 rheometer style A, manufactured by T.A. Instruments, Ltd., Europe House, Bilton Centre, Cleeve Road, Leatherhead, Surrey KT22 7UQ, United Kingdom.

Paste #1 has a viscosity of 350 Pa·s at a shear rate of 1 $s^{-1}$, a G' of 10,500 Pa and G" of 3,500 Pa in the linear viscoelastic region at a constant frequency of 10 $s^{-1}$.

Paste #2 has a viscosity of 450 Pa·s at a shear rate of 1 $s^{-1}$, a G' of 11,000 Pa and G" of 4,000 Pa in the linear viscoelastic region at a constant frequency of 10 $s^{-1}$.

Kit for Cleaning Bathroom Surfaces.

In one embodiment, any of the previously discussed disposable cleaning wipes having any of the previously discussed cleaning compositions can be sold in a package as a cleaning kit.

Since it is relatively counter-intuitive for a consumer to add water to a cleaning wipe before cleaning a surface, it can be beneficial to provide usage instruction to the user. In one embodiment, the usage instructions can be conveyed to the user via any method known in the art such as by words diagrams, pictures or drawings printed on the package or directly onto the wipe.

Preferred usage instructions include the steps of removing the cleaning wipe from the package, applying water to the cleaning wipe and then contacting the surface to be cleaned with the water activated cleaning wipe. When desired, the usage instructions can also include the step of attaching the cleaning wipe to a cleaning implement either before or after the step of applying water to the cleaning wipe and then use the cleaning implement to clean the bathroom surface.

All documents cited in the Detailed Description of the Invention are, are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for cleaning bathroom surfaces with a single use disposable cleaning wipe, comprising the steps of:

providing a disposable wipe comprising a sleeve which provides a pocket for insertion of a consumer's hand or fingers, said wipe comprising at least two nonwoven layers wherein a first cleaning composition in paste form is incorporated into an outer layer of said wipe and a second cleaning composition in aqueous form is incorporated into an inner layer of said wipe wherein said paste comprises from 2% to about 15% water and has a viscosity of about 150 Pascal seconds at a shear rate of 1 $s^{-1}$ to about 10,000 Pascal seconds at a shear rate of 1 $s^{-1}$;

contacting said wipe with water to activate said wipe;

contacting said activated wipe with the bathroom surface to be cleaned;

Optionally rinsing said bathroom surface with water.

2. The method of claim 1 wherein said activated wipe removes soap scum, hard water soils, and mixtures thereof from said bathroom surface.

3. The method of claim 2 wherein said disposable wipe comprises at least one layer of a nonwoven substrate having a basis weight of between about 20 $g/m^2$ and about 200 $g/m^2$, and a density of at least about 0.15 g/cm3.

4. The method of claim 3 wherein said nonwoven substrate has at least one cleaning side and wherein said cleaning composition is applied to said cleaning side.

5. The method of claim 1 wherein said cleaning composition is chosen from at least one of:

a cleaning composition comprising at least about 5% by weight of said composition of a surfactant and at least about 3% by weight of one or more organic or inorganic acids, wherein said composition has a pH of from about 0.5 to about 6;

a cleaning composition comprising at least about 5% by weight of said composition of a surfactant and at least about 3% of one or more sequestrant agents and wherein said composition has a pH of from about 6 to about 12.

6. The method of claim 5 wherein said cleaning composition further comprises at least about 3% by weight of one or more hydrotropes and/or at least about 1% of one or more organic cleaning solvents.

* * * * *